US009964121B2

(12) United States Patent
Schill

(10) Patent No.: US 9,964,121 B2
(45) Date of Patent: May 8, 2018

(54) VACUUM PUMP

(71) Applicant: Pfeiffer Vacuum GmbH, Asslar (DE)

(72) Inventor: Michael Schill, Asslar-Bechlingen (DE)

(73) Assignee: PFEIFFER VACUUM GMBH, Asslar (DE)

( * ) Notice: Subject to any disclaimer, the term of this patent is extended or adjusted under 35 U.S.C. 154(b) by 636 days.

(21) Appl. No.: 14/191,658

(22) Filed: Feb. 27, 2014

(65) Prior Publication Data

US 2014/0241853 A1 Aug. 28, 2014

(30) Foreign Application Priority Data

Feb. 28, 2013 (DE) ..... 10 2013 203 421

(51) Int. Cl.
*F04D 29/58* (2006.01)
*F04D 19/04* (2006.01)

(52) U.S. Cl.
CPC ..... *F04D 29/584* (2013.01); *F04D 19/042* (2013.01)

(58) Field of Classification Search
CPC ..... F04D 19/04; F04D 19/042; F04D 19/044; F04D 29/582; F04D 29/584; F04D 29/5846
See application file for complete search history.

(56) References Cited

U.S. PATENT DOCUMENTS 4,695,223 A 9/1987 Casper
5,707,213 A 1/1998 Conrad
6,019,581 A 2/2000 Schulz-Hausmann
7,090,460 B2 8/2006 Englaender
7,160,081 B2 1/2007 Rival
7,500,821 B2 * 3/2009 Watz ..... F04D 29/584 415/175
2006/0018773 A1 1/2006 Yoshimura

FOREIGN PATENT DOCUMENTS

DE 4438812 A1 * 5/1996 ..... F04D 17/168
DE 10 2006 043 327 3/2008
JP 08-326687 12/1996
JP 2002039902 2/2002
JP 2005-083271 3/2005
JP 2009-203906 9/2009
WO 8906319 7/1989

OTHER PUBLICATIONS

Search Report of the German Patent Office.

* cited by examiner

*Primary Examiner* — Jason Shanske
*Assistant Examiner* — Jesse Prager
(74) *Attorney, Agent, or Firm* — Abelman, Frayne & Schwab

(57) ABSTRACT

A vacuum pump, in particular to a turbomolecular pump, has a pump inlet, a pump outlet and a pump space for a gas to be pumped arranged between the pump inlet and the pump outlet, and at least one cooling gas inlet for a cooling gas for cooling the vacuum pump, the pump further having one or more hollow regions for the cooling gas connected in a gas conducting manner to the cooling gas inlet and arranged outside the pump space, wherein the or each hollow region is bounded by at least one component of the vacuum pump to be cooled.

14 Claims, 3 Drawing Sheets

VACUUM PUMP

BACKGROUND OF THE INVENTION

1. Field of the Invention

The invention relates to a vacuum pump, in particular to a turbomolecular pump, to an arrangement having a vacuum pump, in particular having a turbomolecular pump, and to a method of operating a vacuum pump, in particular a turbomolecular pump.

2. Description of the Prior Art

Vacuum pumps are used in various technical processes such as in semiconductor production to convey away a gas to be pumped, also called a pump gas, out of a volume to be evacuated and to generate a vacuum required for the respective technical process. In this respect, turbomolecular pumps are of particular importance which are operated at high speeds and are able to produce a vacuum with high purity.

In the operation of the known vacuum pumps, a substantial heating of the vacuum pumps takes place which impairs the pump properties and the performance behavior of the vacuum pump, increases the maintenance susceptibility of the vacuum pump and reduces its operating life. It is known to equip a vacuum pump with a cooling device to avoid an excessive heating of the vacuum pump.

Known cooling devices such as water coolers or air coolers, whose cooling effect is based on a flowing around of hot pump components or cooling bodies attached thereto by air, are relatively complex and/or expensive and have limited efficiency. It is in particular only possible with difficulty with the known cooling devices to cool regions of the pump which heat up particularly strongly and are arranged, for example, in the lower region of the pump, in a locally direct manner such that desired temperature relationships are adopted everywhere. An excessive heating thus also occurs in the vacuum pumps cooled in this manner which impairs the pumping properties and performance properties of the vacuum pump and reduces its service life.

It is therefore the object of the invention to provide a vacuum pump, an arrangement having a vacuum pump and a method of operating a vacuum pump with which an improved pump performance and operating life of the vacuum pump can be achieved with a reduced effort and/or expense and with which in particular an effective and sufficient cooling is provided in all regions of the vacuum pump so that the vacuum pump is effectively protected everywhere against excessive heating during operation.

SUMMARY OF THE INVENTION

The object of the invention is achieved by providing vacuum pump, in particular a turbomolecular pump that comprises a pump inlet, a pump outlet and a pump space for a gas to be pumped which is arranged between the pump inlet and the pump outlet. The vacuum pump furthermore comprises at least one cooling gas inlet for a cooling gas for cooling the vacuum pump and one or more hollow regions for the cooling gas connected in a gas conducting manner to the cooling gas inlet and arranged outside the pump space, wherein the or each hollow region is bounded by at least one component of the vacuum pump.

Cooling gas is let directly into the hollow regions arranged in the interior of the vacuum pump via the cooling gas inlet in the operation of the vacuum pump so that the vacuum pump and the components to be cooled which bound the hollow region can be cooled in a locally targeted manner directly in the region of the greatest heat production.

Since the hollow regions provided for the cooling are separate from the pump space of the vacuum pump, an impairment of the pump effect by the cooling gas is avoided just as an impairment of the cooling effect by the gas to be pumped is avoided so that an efficient cooling is ensured with an efficient pump operation.

The vacuum pump can be realized with a very small effort since only one additional inlet for the cooling gas and one hollow region or a plurality of hollow regions for the cooling gas have to be provided. Atmospheric air can e.g. be utilized as the cooling gas which is present at the cooling gas inlet so that no special cooling gas has to be provided.

In accordance with an advantageous embodiment, at least one hollow region and in particular each hollow region is connected in a gas conducting manner to the pump outlet. The cooling gas present at the cooling gas inlet can then be sucked into the cooling gas inlet by the suction of a backing pump (also known as a roughing pump) connected to the pump outlet and is sucked through the hollow region or hollow regions.

A backing pump is anyway used as a rule, in particular in vacuum pumps which work in the very pure vacuum range, such as turbomolecular pumps, and can serve to suck out the gas conveyed into a backing region or backing space of the vacuum pump and in so doing to compress it from a backing pressure present in the backing region to a higher pressure, in particular to atmospheric pressure. The backing region in this respect preferably forms the downstream termination of the pump space. The maximum backing pressure maintained by the backing pump can be adapted so that the upstream pump stages of the vacuum pump which compress against the backing pressure are operated in the range of their ideal pumping behavior and so that minimal end pressures are achieved at the pump inlet.

On a presence of a gas conducting connection between the one or more hollow regions and the pump outlet, the cooling gas can be sucked in through the cooling gas inlet by the suction of the backing pump and can be conveyed through the hollow regions so that a defined cooling gas flow and a compulsory cooling of the vacuum pump are achieved without an additional conveying device for the cooling gas being necessary. The hollow region or each hollow region can in this respect open into a region arranged upstream of the pump outlet, in particular into a backing region of the pump space.

In view of the suction performance ratings of available backing pumps, a good cooling effect is achieved despite the load on the hacking pump by the cooling gas flow in addition to the pump gas flow without the backing pressure in the vacuum pump and thus the pump performance of the vacuum pump being substantially impaired.

It is in principle preferred that the cooling gas flow entering through the cooling gas inlet can be regulated, for example by an adjustability of the flow cross-section of the cooling gas inlet. The desired flow cross-section can e.g. be determined or set via a capillary of the vacuum pump or similar. The cooling gas flow can then in particular also be set in the event of a gas conducting connection between the hollow regions and the pump outlet such that the cooling gas flow does not cause any disturbing impairment of the pump effect.

In accordance with an embodiment, a cooling gas outlet for the cooling gas is provided to which at least one hollow region and in particular every hollow region is connected in a gas conducting manner. The gas cooling can then be realized substantially independently of the pumping process taking place in the pump space and the hollow regions can be completely separate from the pump space within the vacuum pump. The cooling gas can be let into the vacuum pump via the cooling gas inlet, can be conveyed through the one or more hollow regions and can be let out of the vacuum pump at the cooling gas outlet.

A separate cooling gas outlet has the advantage that a choice can be made between different measures for conveying the cooling gas through the hollow region. For example, a compressor can be connected to the cooling gas inlet which compresses the cooling gas, for example, atmospheric gas, and conveys it at pressure into the cooling gas inlet for producing the cooling gas flow. The cooling gas outlet can, on the other hand, also be connected to a backing pump so that the conveying of the cooling gas is effected by the suction of the backing pump. For this purpose, a gas line can be connected to the cooling gas outlet which gas line opens into a backing hose which connects the pump outlet of the vacuum pump to the backing pump so that the total gas flow of pump gas flow and cooling gas flow is introduced at the inlet of the backing pump. The gas line can also connect the cooling gas outlet of the vacuum pump directly to the backing pump and can open, for example, directly into a pump space of the backing pump.

At least one hollow region and in particular every hollow region is preferably separated in a substantially gas-tight manner from the pump space. An increase of the gas pressure present in the pump space as a consequence of the cooling gas flow and an accompanying deterioration of the pump power can thereby be very largely avoided. The cooling gas conveyed into the pump can in this respect e.g. be conveyed away through a cooling gas outlet as described above. The gas-tight separation also comprises an embodiment in which the hollow regions and the pump space are connected to one another outside the vacuum pump and thus only indirectly in a gas conducting manner, e.g. via a backing hose of a backing pump conveying the pump gas and the cooling gas.

In accordance with a further advantageous embodiment, at least one hollow region and in particular every hollow region is connected in a gas conducting manner to the pump space or to the pump outlet downstream of all pump stages of the vacuum pump provided for pumping the gas present in the pump space. The at least one hollow region or every hollow region is preferably separated in a gas-tight manner from the regions of the pump space arranged upstream thereof, i.e. the hollow region is only connected in a gas conducting manner to the pump space or to the pump outlet downstream of all pump stages, e.g. in the region of a backing region. An impairment of the pump power by the cooling gas can thereby be very largely avoided since the cooling gas entering into the downstream region of the pump space or into the pump outlet can be conveyed away e.g. directly by a backing pump connected to the pump outlet without the backing pressure substantially increasing.

One or more molecular and in particular turbomolecular pump stages are e.g. provided as the pump stages. Alternatively or additionally to one or more turbomolecular pump stages, one or more Holweck pump stages, Siegbahn pump stages, Gaede pump stages or side passage pump stages can be provided, in particular downstream of the one or more turbomolecular pump stages.

In accordance with an embodiment, at least one hollow region and in particular every hollow region is configured as a passage. This embodiment has the advantage with respect to an extended hollow region that the achieved cooling effect can be set locally directly and exactly everywhere in the vacuum pump by a corresponding passage guidance. At least one passage and in particular every passage can have an elongate shape at least over a part of its length and in particular over at least approximately its total length and can e.g. be substantially tubular, or of longitudinal slit shape or longitudinal gap shape.

In principle, a plurality of passages can be provided for the cooling gas which can be connected to the cooling gas inlet or to one another in a gas conducting manner. In this respect, a plurality of passages can be connected to one another in a gas conductive manner in series or in parallel to one another in the flow direction. An embodiment is also possible having a plurality of mutually branched passages. In order to achieve a sufficient cooling effect everywhere in the pump, provision is preferably made that at least one passage or a plurality of passages taken together form a length which corresponds at least to half the flow diameter, and preferably to at least one time, two times or three times the flow diameter, of a suction flange of the vacuum pump forming the pump inlet.

At least one passage and in particular every passage preferably extends substantially in ring shape, in particular in circular ring shape, or ring segment shape, in particular circular ring segment shape, about an axis of rotation of the vacuum pump. The vacuum pump can in principle be at least approximately rotationally symmetrical to the axis of rotation in order e.g. to rotate the rotating components of the pump stages. In this case, a sufficient and uniform cooling effect in the total vacuum pump can be achieved by a ring-shaped passage. For this purpose, at least one passage or a plurality of passages together can cover at least 50%, preferably at least 75% and particularly preferably at least approximately the whole angular range defined relative to the axis of rotation of the vacuum pump.

The respective passage can have a radial spacing from the axis of rotation over a part of its length or at least approximately over its total length and can e.g. be arranged in the spacing region which extends from half the outer diameter to the entire outer diameter of the backing pump. The respective passage can, for example, have the shape of a ring gap, a ring slit, a ring tube or a segment of a corresponding ring shape.

To achieve a sufficient cooling of the vacuum pump everywhere, at least two passages can be provided for the cooling gas which in particular extend in different directions about the axis of rotation of the vacuum pump. The passages can in this respect each be directly connected in a gas conducting manner to the cooling gas inlet at one of their ends and/or can each be connected to one another in a gas conducting manner at their other ends or can open into a common region of the vacuum pump. In principle, a plurality of passages can also be provided spaced apart in the axial direction, i.e. in the direction of the axis of rotation.

In principle, a passage can have a closed cross-section perpendicular to its longitudinal extent except for any branches to further passages or to further hollow regions and at least over a part of its length and in particular over at least approximately its total length.

In accordance with an embodiment, at least one passage and in particular every passage forms a flow cross-sectional surface for the cooling gas over at least a part of its length and in particular over at least approximately its total length, said flow cross-sectional surface being so large at a maximum as the flow cross-sectional surface of the pump outlet and in particular being smaller than the flow cross-sectional surface of the pump outlet. The backing pressure is then optionally at best slightly increased by the cooling and in addition a cooling satisfying the respective demands is achieved everywhere in the vacuum pump.

At least one hollow region and in particular every hollow region preferably at least regionally has a closed cross-section which is in particular completely bounded by at least one static component of the vacuum pump. An effective sealing of the hollow region from the pump space and an efficient cooling of the static pump components and thus of the vacuum pump overall can thereby be achieved. The hollow region or the hollow regions can be formed as a passage or passages which, as described above, can have a closed cross-section at least apart from any branches to further channels or to further hollow regions and at least over a part of their lengths and in particular over at least approximately their total lengths.

In an embodiment which is particularly simple to realize, the closed cross-section of one or of every hollow region, in particular of one or every passage, is bounded by at least two static components of the vacuum pump at least in a section of the hollow region or at least in a longitudinal section of the passage and in particular everywhere completely. The hollow region or passage is therefore enclosed by at least two components which each bound the cross-section of the hollow region at least partly. The hollow region can be formed at least partly by a groove-shaped cut-out or depression of a component which is covered by the other component for forming the hollow region. The hollow region or passage can also be formed by a gap or slit, in particular a ring gap or a ring slit, between the components. To seal the hollow region, the two components can contact one another directly in a gas-sealing manner at the margin of the hollow region and/or can each contact a common sealing element.

A particularly favorable embodiment from a construction aspect comprises a groove whose groove walls partly bound the hollow region being formed in a lower part of the vacuum pump, which lower part is arranged at least partly in a lower region of the pump and e.g. forms a part of a housing of the vacuum pump or a containment for a pivot bearing and/or a drive of the pump. A further, preferably flat-shaped component can close the groove opening and can thereby complete the enclosure of the hollow region so that the hollow region has a closed cross-section. In this respect, the groove can project into the lower part in the axial direction. The flat-shaped component can e.g. be fixed in an existing opening of the lower part which projects inward axially, which is in particular throughgoing, via which the groove is accessible and into which e.g. a pivot bearing and/or a drive of the pump can be inserted. The groove in this respect preferably has a substantially circular ring-shaped or circular ring-segment shaped extent and the further component can accordingly be formed by a likewise circular ring-shaped or circular ring-segment shaped and preferably flat-shaped ring or part ring.

In principle, the closed cross-section can also be bounded by exactly one static component of the vacuum pump at least in one section of the hollow region or longitudinal section of the passage and in particular everywhere completely. The hollow region or passage can in this respect be formed by a throughgoing cu-out in the solid material of the respective component.

At least one hollow region and in particular every hollow region is preferably arranged at least partly in a region of the vacuum pump which is spaced apart from the pump stages of the vacuum pump in the direction of the axis of rotation and which is also called a lower region. A pivot bearing for a rotor shaft and/or a drive of the vacuum pump can e.g. be arranged in the lower region. A hollow region or every hollow region can e.g. be arranged in a lower part or can be at least partly bounded thereby. A hollow region can also be bounded at least partly by a baffle in particular arranged in the lower region or by a flat-shaped component of the vacuum pump. To ensure a good thermal transport, the enclosure of one or of every hollow region can be formed at least partly and in particular completely by a thermally conducting and in particular metallic material.

In the simplest case, the atmospheric air can be used as the cooling gas which is present at the cooling gas inlet, preferably at atmospheric pressure and/or room temperature. In every case, a cooling gas is introduced into the cooling gas inlet which is cooler than the desired maximum temperature of the pump. The cooling gas can be conducted through an air cooling arranged outside the vacuum pump or at the outside of the vacuum pump or through flow passages arranged outside the vacuum pump upstream of the cooling gas inlet.

An inlet and an outlet of the vacuum pump are always to be understood in the present description as an inlet or outlet accessible from the outside of the vacuum pump and connecting the outside of the vacuum pump in a gas conducting manner to the interior of the vacuum pump which is bounded e.g. by a housing of the vacuum pump. The cooling gas inlet accordingly connects the outside of the vacuum pump to the interior of the vacuum pump in which the hollow region or hollow regions is/are arranged. An inlet or outlet can comprise a flange surrounding a respective inlet opening or outlet opening, but can also be formed by a simple inlet opening or outlet opening.

In principle, the vacuum pump can comprise a plurality of hollow regions. When reference is made in the present description to a "hollow region" or to a "passage" or to "hollow regions" or to "passages", the respective description is always to be related, unless otherwise stated, equally to at least one hollow region or passage, which is optionally also to be understood as the only hollow region or passage, to a plurality of hollow regions or passages and in particular to all hollow regions or passages. The vacuum pump can also have a plurality of cooling gas inlets which are each connected in a gas conducting manner to at least one hollow region.

A further subject of the invention is a vacuum arrangement having a vacuum pump in accordance with the invention in accordance with the present description, wherein a cooling gas for cooling the vacuum pump is provided at the cooling gas inlet of the vacuum pump and a recipient separate from the cooling gas inlet and having a gas to be pumped is connected to the pump inlet of the vacuum pump. Whereas the recipient preferably forms a closed, substantially gas-tight volume which is connected to the pump inlet, the cooling gas provided at the cooling gas inlet can, for example, be atmospheric air, in which case the cooling gas inlet can simply be exposed to the normal atmosphere. A backing pump which conveys away the gas pumped by the backing pump and optionally additionally the cooling gas can be connected to the pump outlet. The embodiments described above with respect to the vacuum pump and its use in a vacuum arrangement, in particular with a backing pump, represent correspondingly advantageous embodiments of the vacuum arrangement in accordance with the invention.

The invention furthermore relates to a method of operating a vacuum pump in accordance with the invention in accordance with the present description or a vacuum arrangement in accordance with the invention having a vacuum pump in accordance with the present description, wherein a cooling gas for cooling the vacuum pump, in particular atmospheric air, is provided at the cooling gas inlet of the vacuum pump and wherein a gas to be pumped which is separate from the cooling gas is provided at the pump inlet of the vacuum pump. The gas to be pumped can in this respect be provided in a closed recipient, whereas in particular the normal atmospheric air can be used as the cooling gas, with the cooling gas inlet being able to be exposed to this atmospheric air. The advantageous embodiments described above with respect to the vacuum pump and to the vacuum arrangement and to their use represent correspondingly advantageous embodiments of the method in accordance with the invention. The suction of a backing pump is preferably used to convey both the cooling gas and the pump gas.

BRIEF DESCRIPTION OF THE DRAWINGS

The present invention is described in the following by way of example with reference to advantageous embodiments and to the enclosed drawings. The drawings show.

DETAILED DESCRIPTION OF THE PREFERRED EMBODIMENTS

Figure 1:
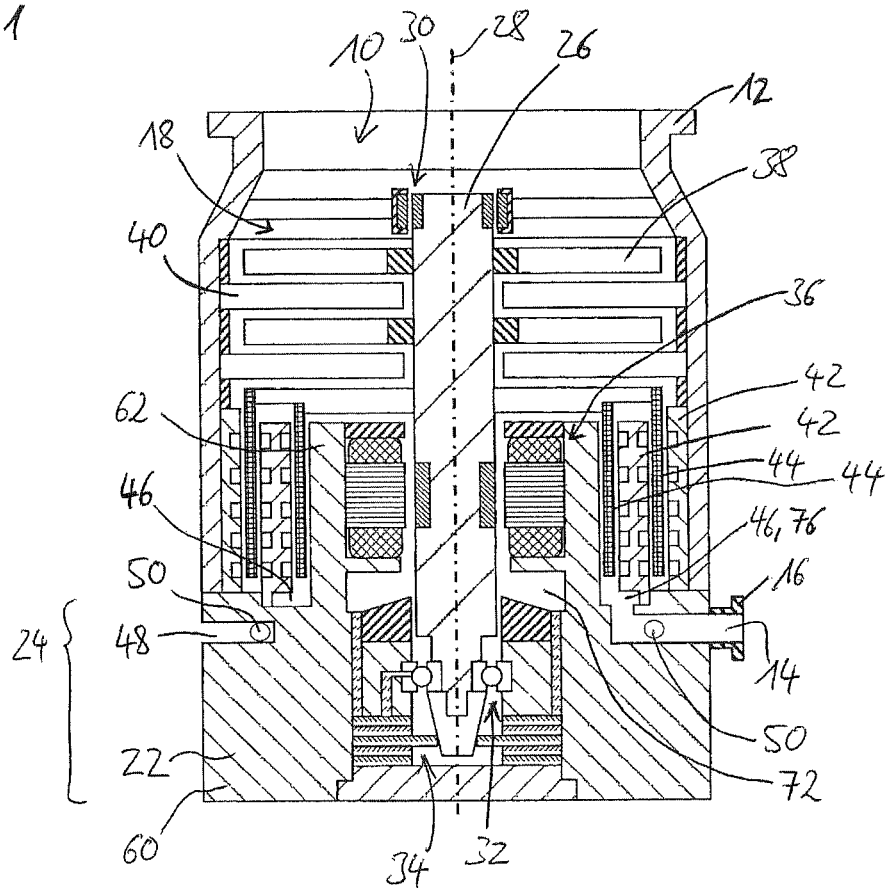
FIG. 1 an axial cross-sectional view of a vacuum pump in accordance with an embodiment of the invention.

The vacuum pump shown in FIG. 1 comprises a pump inlet 10 which is surrounded by an inlet flange 12, a pump inlet outlet 14 which is surrounded by an outlet flange 16 and a pump space 18 which is arranged therebetween and through which the gas to be pumped is conveyed in the operation of the pump and which is also called a suction chamber. An upper housing part 20 and a lower part 22 form a housing of the vacuum pump.

The vacuum pump comprises a rotor shaft 26 which is supported rotatably about an axis of rotation 28 in the vacuum pump by a magnetic bearing and a ball bearing 32 which is supplied with lubricant by a lubrication device 34. An electrical drive 36 serves for the rotating drive of the rotor shaft 26.

The magnetic bearing 30 and the pump stages described in the following are received in the upper housing part 20. The lower part 22 forms a containment for the ball bearing 32 and for the lubrication device 34, which are located in the lower region 24 of the vacuum pump, and for the drive 36. The lower part 22 is formed by a base section 60 and by a functional section 62 and comprises a throughgoing opening 72 and a groove 76, with these components being explained in more detail in the following with respect to FIGS. 4 to 6.

The vacuum pump comprises a plurality of rotor disks 38 which are arranged at the rotor shaft 26, extend in the radial direction and are provided with radial blades. Stator disks 40 are furthermore provided which likewise extend in the radial direction, are provided with radial blades and are arranged and fixed in the housing of the vacuum pump such that they are disposed opposite the rotor disks 38 at a slight axial spacing. A rotor disk 38 in this respect forms a respective turbomolecular pump stage of the vacuum pump with an oppositely disposed stator disk 40.

Three mutually nestled Holweck pump stages of the vacuum pump follow downstream of the turbomolecular pump stages and are formed by a plurality of Holweck stators 42 of cylinder jacket shape arranged concentrically to the axis of rotation 28 and by Holweck rotor sleeves 44 likewise of cylinder jacket shape, arranged concentrically to the axis of rotation 28 and connected to the rotor shaft 26. A pump-active radial surface of a Holweck stator 42 forming a plurality of grooves in helical shape is disposed in this respect opposite a smooth radial surface of a Holweck rotor sleeve 44 at a slight radial spacing so that a thin gap is formed between the surfaces. The mutually oppositely disposed surfaces together form a respective Holweck pump stage, wherein the gas molecules are driven in the helical grooves in the operation of the vacuum pump and are thus conveyed in an axial direction.

Downstream of the three Holweck pump stages connected in series in the direction of flow, a backing region 46 of the vacuum pump is formed in which the gas conveyed through the pump stages is collected which is subsequently discharged via the pump outlet 14 connected in a gas conducting manner to the backing region 46.

The vacuum pump furthermore comprises a cooling gas inlet 48 which is formed in the lower part 22 and connects a passage 50 for the cooling gas formed in the interior of the lower part 22 in a gas conducting manner to the pump exterior and to the atmospheric air present there.

The cooling gas inlet 48 extends in the radial direction into the vacuum pump and opens into the cooling gas passage 50 which has a substantially round cross-section, extends substantially in a semicircular manner about the axis of rotation 28 and opens into the pump outlet 14.

When a backing pump is connected to the pump outlet 14, atmospheric air can be conveyed by the suction of the backing pump through the cooling gas inlet 48 into the vacuum pump and through the passage 50 to the pump outlet 14 and can be sucked off there by the backing pump. In this respect, the atmospheric air cools the regions of the lower part 22 bounding the passage 50, whereby an excessive heating in the operation of the vacuum pump is prevented.

In principle, more cooling gas passages 50 and/or a plurality of cooling gas inlets 48 can be provided which can each be connected in a gas conducting manner to the pump outlet 14.

Figure 2:
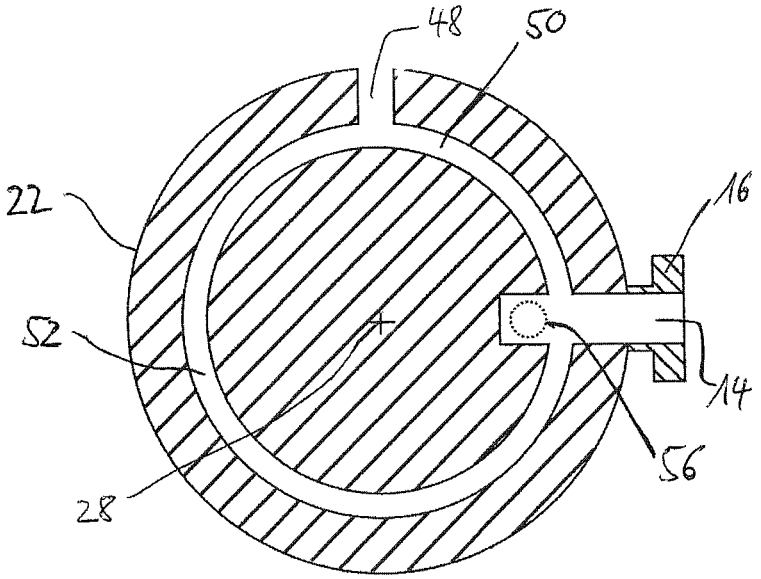
FIG. 2 a schematic cross-sectional view of a lower region of a vacuum pump in accordance with a further embodiment of the invention.

FIG. 2 shows a lower region 24 of a vacuum pump in accordance with a further embodiment in cross-section which substantially corresponds to the vacuum pump shown in FIG. 1. The pump components which can be received in the lower part 22 such as a pivot bearing shown in FIG. 1 or a lubrication device are not shown in FIG. 2 and the lower part 22 is instead shown in throughgoing form.

The pump shown in FIG. 2 has two cooling gas passages 50, 52 which are each connected in a gas conducting manner to the cooling gas inlet 48. which extend, starting from the cooling gas inlet 48, in opposite directions in substantially semi-circular ring shape about the axis of rotation 28 and which open into the pump outlet 14. An effective cooling is thereby achieved over the total angular range about the axis of rotation 28. The gas conducting connection between the backing region of the vacuum pump and the pump outlet 14 is shown by the dashed circle 56 in FIG. 2.

Figure 3:
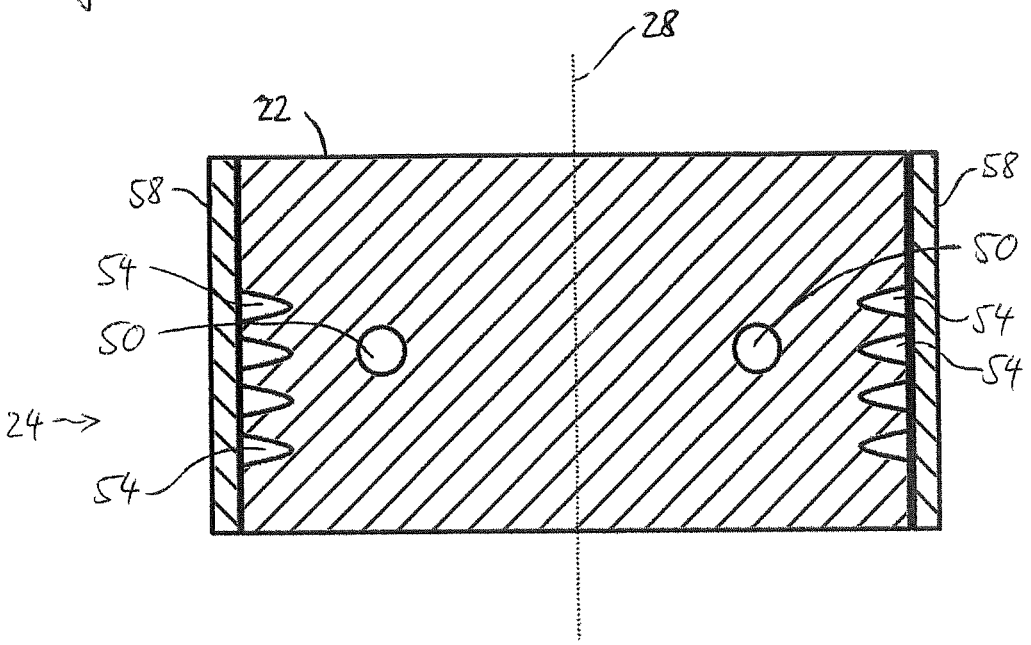
FIG. 3 a schematic axial cross-sectional view of a lower region of a vacuum pump in accordance with a still further embodiment of the invention.

FIG. 3 shows the lower region 24 of a vacuum pump in accordance with a further embodiment of the invention in an axial section with a lower part 22 which is shown through-going as in FIG. 2. The vacuum pump has a plurality of cooling gas passages 50, 54 which are each connected in a gas conducting manner to a cooling gas inlet not shown in FIG. 3.

The vacuum pump on the one hand comprises passages 50 which are completely bounded by the solid material of the lower part 22. On the other hand, the vacuum pump comprises passages 54 which are enclosed, on the one hand, by the groove walls of grooves which are provided at the radial outer sides of the lower part 22 and, on the other hand, by outer metal sheets 58 which are connected in a gas-sealing manner to the lower part 22 and bound the passages 54 outwardly in the radial direction. The outer metal sheets 58 together with the lower part 22 bound an approximately triangular cross-section of the individual passages 54.

Figure 4:
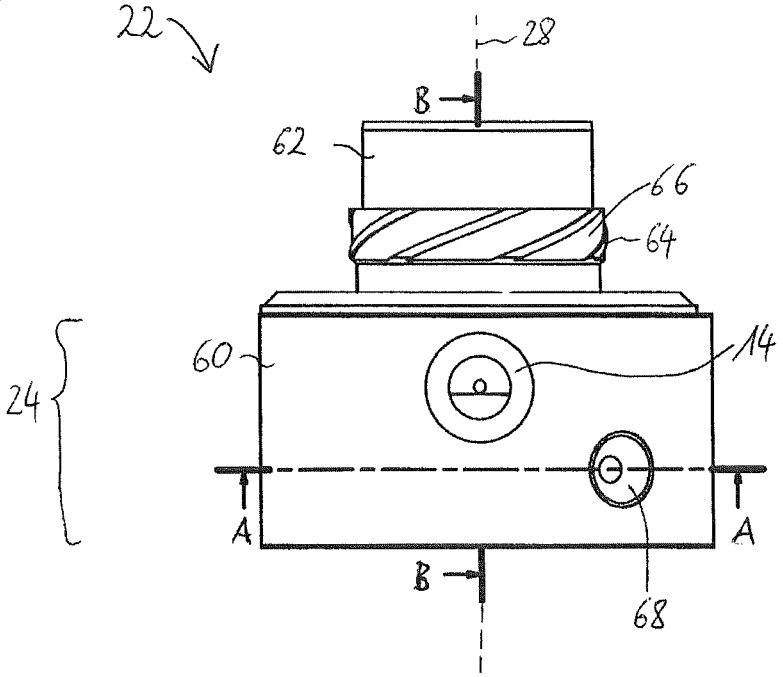
FIG. 4 a side view of a lower part of a vacuum pump in accordance with a yet further embodiment of the invention.

FIG. 4 shows a lower part 22 of a vacuum pump in accordance with a further embodiment of the invention in a side view. The lower part 22 comprises a base section 60 which extends approximately cylindrically about the axis 28 and which forms the lower region 24 of the vacuum pump on the use of the lower part 22 in a vacuum pump. The lower part 24 additionally comprises a functional section 62 which projects in stub form in the axial direction with respect to the base section 60, which is substantially rotationally symmetrical to the axis 28 and which cooperates in the manner described in the following with the components of the vacuum pump directly involved in the pump function.

The functional section 62 comprises a section 64 projecting in collar-shape in the radial direction and having a plurality of grooves 66 extending helically about the axis 28. On a use in the vacuum pump, the section 64 forms a gap having a small radial gap width with the inner surface of a Holweck rotor sleeve 44 rotating about the axis 28 (see FIG. 1). The section 64 and the Holweck rotor sleeve 44 in this respect cooperate in the manner of a Holweck pump stage and form a dynamic seal which seals the pump space with respect to the adjacent hollow spaces of the pump.

The base section 60 comprises a pump outlet 14 as well as a cooling gas outlet 68 separated in a gas-tight manner from the pump outlet 14.

Figure 5:
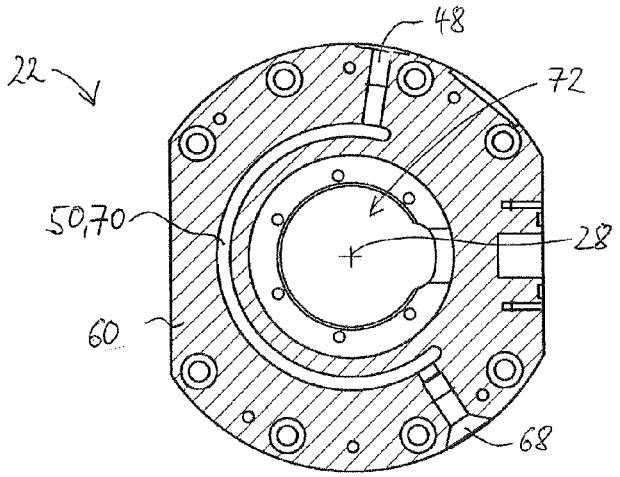
FIG. 5 a cross-sectional view of the lower part shown in FIG. 4 along the line A-A of FIG. 4.
Figure 6:
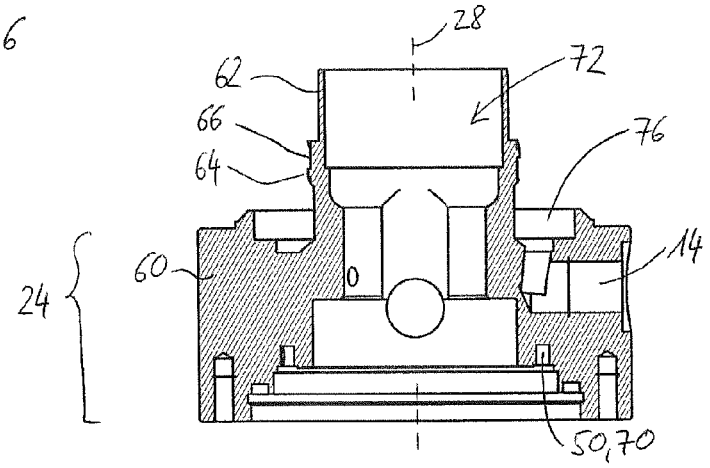
FIG. 6 a cross-sectional view of the lower part shown in FIGS. 4 and 5 along the line B-B of FIG. 4.

FIGS. 5 and 6 show the lower part 22 shown in FIG. 4 in a representation sectioned along the line A-A or B-B of FIG. 4. The lower part 22 comprises a cooling gas inlet 48 and a groove 70 which is formed to bound a cooling gas passage 50, which projects inward in the axial direction and which extends in the form of a circle line about the axis 28 to the cooling gas outlet 28, with the groove 70 covering an angular range of approximately 220°. As shown in FIG. 6, the groove 70 is accessible from the outside via an opening 72 of the lower part 22.

Figure 7:
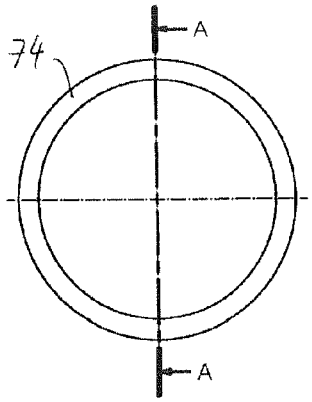
FIG. 7 a lower part shown in FIGS. 4 to 6 for forming a ring which can be used for forming a cooling gas passage.
Figure 8:
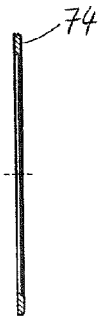
FIG. 8 a cross-sectional view of the ring shown in FIG. 7 along the line A-A of FIG. 7.

FIGS. 7 and 8 show a circular ring 74 having a flat cross-section which can be fixed in the opening 72 such that the ring 74 closes the groove 70 and form a closed cross-section for the cooling gas passage 50 with the groove walls.

The lower part 22 additionally comprises a groove 76 (FIG. 5) for bounding the backing region 46 and a pump outlet 14 connected thereto in a gas conducting manner. As can be seen with reference to FIGS. 5 and 6, the cooling gas passage 50 in this embodiment extends in an axial direction beneath the pump outlet 14 is completely separated in a gas-tight manner from the backing region 48 and the pump space 18 overall. Compressed air can be provided e.g. at the cooling gas inlet 48 to produce a cooling gas flow in the cooling gas passage 50. Alternatively, the cooling gas outlet 68 can be connected outside the vacuum pump and thus downstream of the pump outlet 14 to a backing pump which can also be connected to the pump outlet 14.

The opening 72 extends in an axial direction through the base section 60 and the functional section 62 of the lower part 22, with a drive 36 (see FIG. 1) being able to be fixed in the region of the functional section 62 and a pivot bearing 32 of the pump being able to be fixed in the opening 72 in the region of the base section 60 so that the lower part 22 forms a containment for these components. The lower end of the opening 72 can be closed by a cover, not shown.

What is claimed is:

1. A vacuum pump having a pump inlet (10), a pump outlet (14) and a pump space (18) for a gas to be pumped, said gas space being arranged between the pump inlet (10) and the pump outlet (14), as well as having at least one cooling gas inlet (48) for a cooling gas for cooling the vacuum pump and having at least two hollow regions (50, 52, 54) for the cooling gas, said at least two hollow regions being connected in a gas conducting manner to the at least one cooling gas inlet (48) and being arranged outside the pump space (18), wherein each of the at least two hollow regions (50, 52, 54) is bounded by at least one component (22, 58, 74) of the vacuum pump, wherein each of the at least two hollow regions (50, 52, 54) is formed as a passage, wherein the at least two passages extend in different directions about a rotational axis (28) of the vacuum pump, wherein the at least two passages are provided in a thermally conducting lower part of the vacuum pump, wherein the at least two passages open into the pump outlet, and wherein the pump outlet is connected to a backing region (46) of the vacuum pump.

2. The vacuum pump in accordance with claim 1, wherein each passage of the at least two passages (50, 52, 54) extends about an axis of rotation (28) of the vacuum pump and extends in one of a ring shape or a ring segment shape about the axis of rotation (28) of the vacuum pump.

3. The vacuum pump in accordance with claim 1, wherein each passage of the at least two passages (50, 52, 54) forms a flow cross-sectional surface for the cooling gas over at least a part of the length of each passage of the at least two passages.

4. The vacuum pump in accordance with claim 1, wherein each passage of the at least two passages (50, 52, 54) forms a flow cross-sectional surface for the cooling gas over at least a part of the length of each passage of the at least two passages, said flow cross-sectional surface being as large at a maximum as the flow cross-sectional surface of the pump outlet (14).

5. The vacuum pump in accordance with claim 4, wherein said flow cross-sectional surface is smaller than a flow cross-sectional surface of the pump outlet (14).

6. The vacuum pump in accordance with claim 1, wherein each passage of the at least two passages (50, 52, 54) forms a flow cross-sectional surface over the total length of each passage of the at least two passages, said flow cross-sectional surface being as large at a maximum as the flow cross-sectional surface of the pump outlet (14).

7. The vacuum pump in accordance with claim 6, wherein said flow cross-sectional surface is smaller than a flow cross-sectional surface of the pump outlet (14).

8. The vacuum pump in accordance with claim 1, wherein each of the at least two hollow regions (50, 52, 54) has at least regionally a closed cross-section which is completely bounded by at least one static component (22, 58, 74) of the vacuum pump.

9. The vacuum pump in accordance with claim 1, wherein the entire length of each of the at least two hollow regions (50, 52, 54) has a closed cross-section which is completely bounded by at least one static component (22, 58, 74) of the vacuum pump.

10. The vacuum pump in accordance with claim 8, wherein the closed cross-section is bounded at least in one section of the hollow region (50, 52, 54) by at least two static components (22, 58, 74) of the vacuum pump.

11. The vacuum pump in accordance with claim 9, wherein the entire length of the closed cross-section is bounded completely by at least two static components (22, 58, 74) of the vacuum pump.

12. A vacuum arrangement having a vacuum pump comprising a pump inlet (10), a pump outlet (14) and a pump space (18) for a gas to be pumped arranged between the pump inlet (10) and the pump outlet (14), the vacuum pump also comprising at least one cooling gas inlet (48) and at least two hollow regions (50, 52, 54) for a cooling gas, said at least two hollow regions being connected in a gas conducting manner to the at least one cooling gas inlet (48) and being arranged outside the pump space (18), wherein each of the at least two hollow regions (50, 52, 54) is bound by at least one component (22, 58, 74) of the vacuum pump, wherein each of the at least two hollow regions (50, 52, 54) is formed as a passage, wherein the at least two passages extend in different directions about a rotational axis (28) of the vacuum pump, and wherein the at least two passages are provided in a thermally conducting lower part of the vacuum pump, wherein the at least two passages (50, 52) open into the pump outlet (14), that is connected with a backing region of the pump wherein the cooling gas for cooling the vacuum pump is provided at the cooling gas inlet (48) of the vacuum pump, and a recipient having a gas to be pumped and separate from the cooling gas inlet (48) is connected to the pump inlet (10) of the vacuum pump.

13. A method of operating one of a vacuum pump and a vacuum arrangement having such a vacuum pump, said vacuum pump comprising a pump inlet (10), a pump outlet (14) and a pump space (18) for a gas to be pumped arranged between the pump inlet (10) and the pump outlet (14), the vacuum pump also comprising at least one cooling gas inlet (48) and at least two hollow regions (50, 52, 54) for a cooling gas, said each of the at least two hollow regions being connected in a gas conducting manner to the at least one cooling gas inlet (48) and being arranged outside the pump space (18), wherein each of the at least two hollow regions (50, 52, 54) is bounded by at least one component (22, 58, 74) of the vacuum pump, each of the at least two hollow regions formed as a passage, the at least two passages extending in different directions about a rotational axis of the vacuum pump and are provided in a thermally conducting lower part of the vacuum pump, the at least two passages open into the pump outlet (14), and wherein the pump outlet is connected with a backing region of the pump, the method comprising the steps of:

providing the cooling gas for cooling the vacuum pump at the cooling gas inlet (48) of the vacuum pump; and providing a gas to be pumped separate from the cooling gas at the pump inlet (10) of the vacuum pump.

14. The vacuum pump in accordance with claim 1, wherein the at least two hollow regions (50, 52, 54) and each of the at least two hollow regions (50, 52, 54) is connected to the pump outlet (14) in a gas conducting manner downstream of all the pump stages (38, 40, 42, 44) of the vacuum pump provided for pumping a gas present in the pump space (18).

* * * * *